United States Patent [19]

Jones, Jr. et al.

[11] 4,388,974

[45] Jun. 21, 1983

[54] VARIABLE DIAMETER DRILL ROD STABILIZER

[75] Inventors: Emrys H. Jones, Jr.; Pramod C. Thakur, both of Morgantown, W. Va.

[73] Assignee: Conoco Inc., Ponca City, Okla.

[21] Appl. No.: 253,462

[22] Filed: Apr. 13, 1981

[51] Int. Cl.[3] ..... E21B 7/08

[52] U.S. Cl. ..... 175/325; 175/76

[58] Field of Search ..... 175/76, 73, 325, 61, 175/299, 267; 166/212; 267/71

[56] References Cited

U.S. PATENT DOCUMENTS

| | | | |
|---|---|---|---|
| 1,323,391 | 12/1919 | Hillman | 267/71 |
| 2,319,236 | 5/1943 | Isaacus et al. | 175/73 |
| 2,643,859 | 6/1953 | Brown | 175/73 |
| 3,098,534 | 7/1963 | Carr et al. | 175/73 |
| 3,301,337 | 1/1967 | Vaughn et al. | 175/77 X |
| 4,270,619 | 6/1981 | Base | 175/61 |

*Primary Examiner*—James A. Leppink
*Assistant Examiner*—Michael J. Starinsky
*Attorney, Agent, or Firm*—Richard W. Collins

[57] ABSTRACT

A variable diameter drill rod stabilizer including an inner piston having cam surfaces which bear against wall engaging segments. Movement of the piston axially within a drill rod section by differential pressure of a fluid flowing through a passage in the piston moves the wall engaging segments radially and controls the diameter of the stabilizer.

3 Claims, 8 Drawing Figures

VARIABLE DIAMETER DRILL ROD STABILIZER

BACKGROUND OF THE INVENTION

This invention relates to drilling of boreholes through subterranean formations, and more particularly to directional control during substantially horizontal drilling through such formations.

The drilling of horizontal boreholes through coal seams in advance of mining for release of methane gas has recently been a subject of intense interest and activity. It is important in such drilling to be able to control the borehole trajectory so that it remains in the coal seam. In an effort to provide this control, considerable work has been done in the area of stabilizers attached to a drill rod string. One such stabilizer is described in U.S. Pat. No. 4,108,256, and a discussion of related work with stabilizers also appears in that patent.

Expandible borehole wall engaging means on a drill rod string are described in U.S. Pat. No. 3,797,589, but are intended for use in advancing the drill string rather than to provide directional control.

There has been a need for a drill rod stabilizer that can provide elevational control to a horizontal borehole being drilled, without the requirement of removing or relocating the stabilizer when a change in borehole trajectory is desired. Such a device is provided by the present invention.

SUMMARY OF THE INVENTION

According to the present invention, elevational control of a generally horizontally borehole being drilled through a subterranean formation is provided by a variable diameter drill rod stabilizer forming a part of the drill rod string. The stabilizer has an inner piston having tapered outer surfaces which cam against wall engaging segments in the stabilizer. Movement of the piston axially within a housing forming a part of the drill rod string by differential pressure of fluid flowing through a passage in the piston controls the diameter of the stabilizer.

DESCRIPTION OF THE PREFERRED EMBODIMENT

The following detailed description, in conjunction with the drawings, describes the most preferred version of a variable diameter stabilizer and its operation. The operation of the stabilizer in a drilling operation will be described in the context of drilling a generally horizontal borehole through a coal seam, but it will be appreciated that the stabilizer has utility in drilling boreholes generally.

It is often desirable in degasifying a coal seam to drill a series of gas drainage holes for distances of 300 meters and more into the coal seam. Maintaining the bit on a horizontal trajectory parallel to the bedding planes of the coal bed is difficult. The natural tendency of the bit during horizontal drilling is to arc downward due to the forces of gravity. Other factors such as inclusions in the coal bed may also cause the bit to tend to deviate from the plane of the coal seam.

Prior to this invention, there were several approaches taken to maintain the bit trajectory along the desired path. The primary factors affecting the borehole trajectory are bit thrust and bit rotational speed. As a general rule, decreased thrust and increased rotational speed tend to cause a downward trajectory, while increased thrust and reduced rotational speed tend to cause an upward trajectory. It is also known that positioning a stabilizer on the drill rod near the drill bit increases the tendency of the bit to move upwardly. Using prior art procedures, it was sometimes necessary, upon encountering a downward dip in a coal bed, to remove the drill string from the hole and remove a stabilizer from adjacent the bit. This procedure is time consuming and costly, and it would be desirable to be able to eliminate the effect of the stabilizer without the necessity of removing the drill string from the hole, particulary after the hole has been drilled a substantial distance into the formation. This capability can be provided by a stabilizer which can be expanded or contracted in place by an operator.

Figure 1:
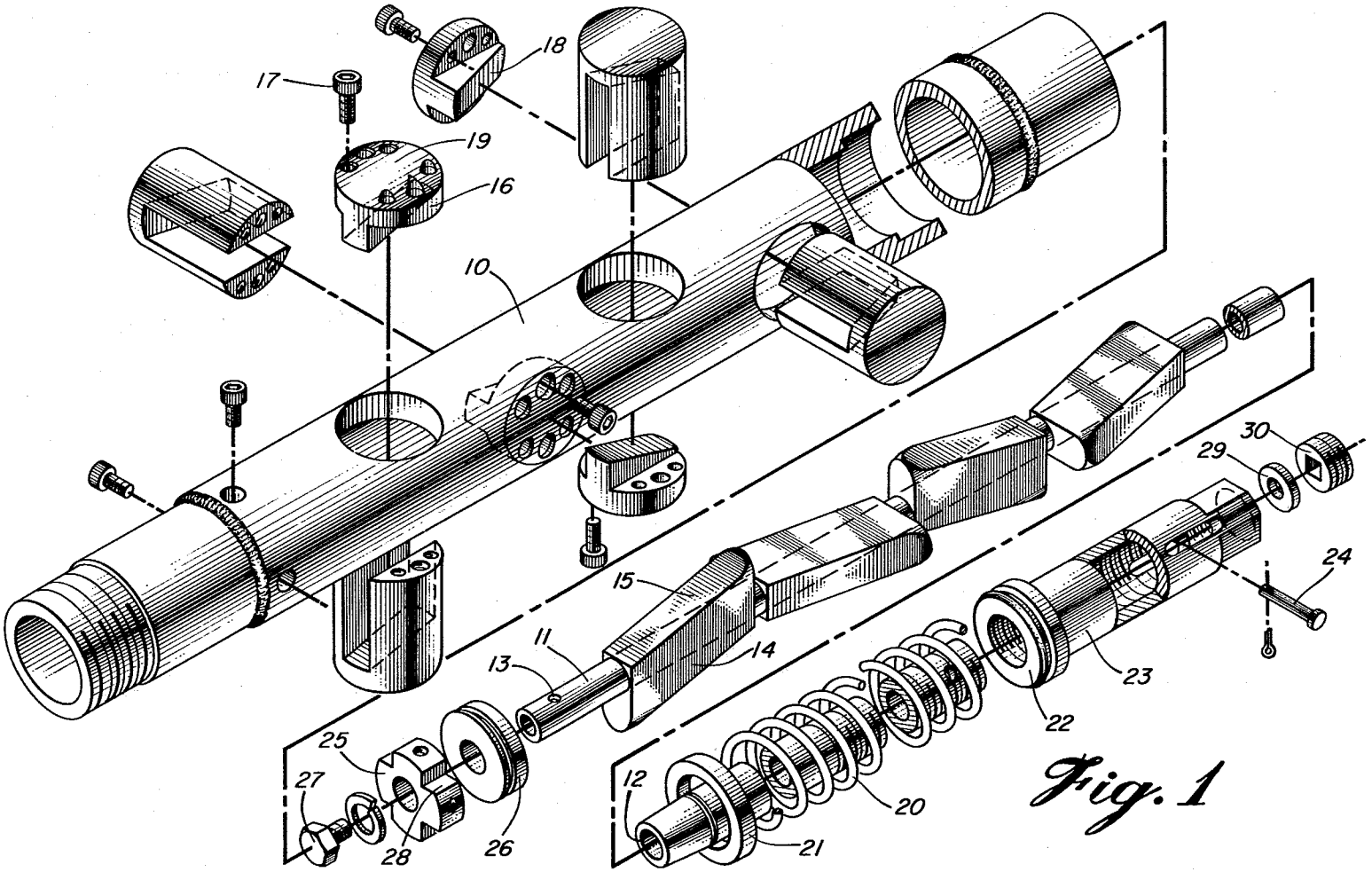
FIG. 1 is an exploded view of a stabilizer in accordance with the invention.
Figures 2, 2A, 3, 4, 5, 6, 7:
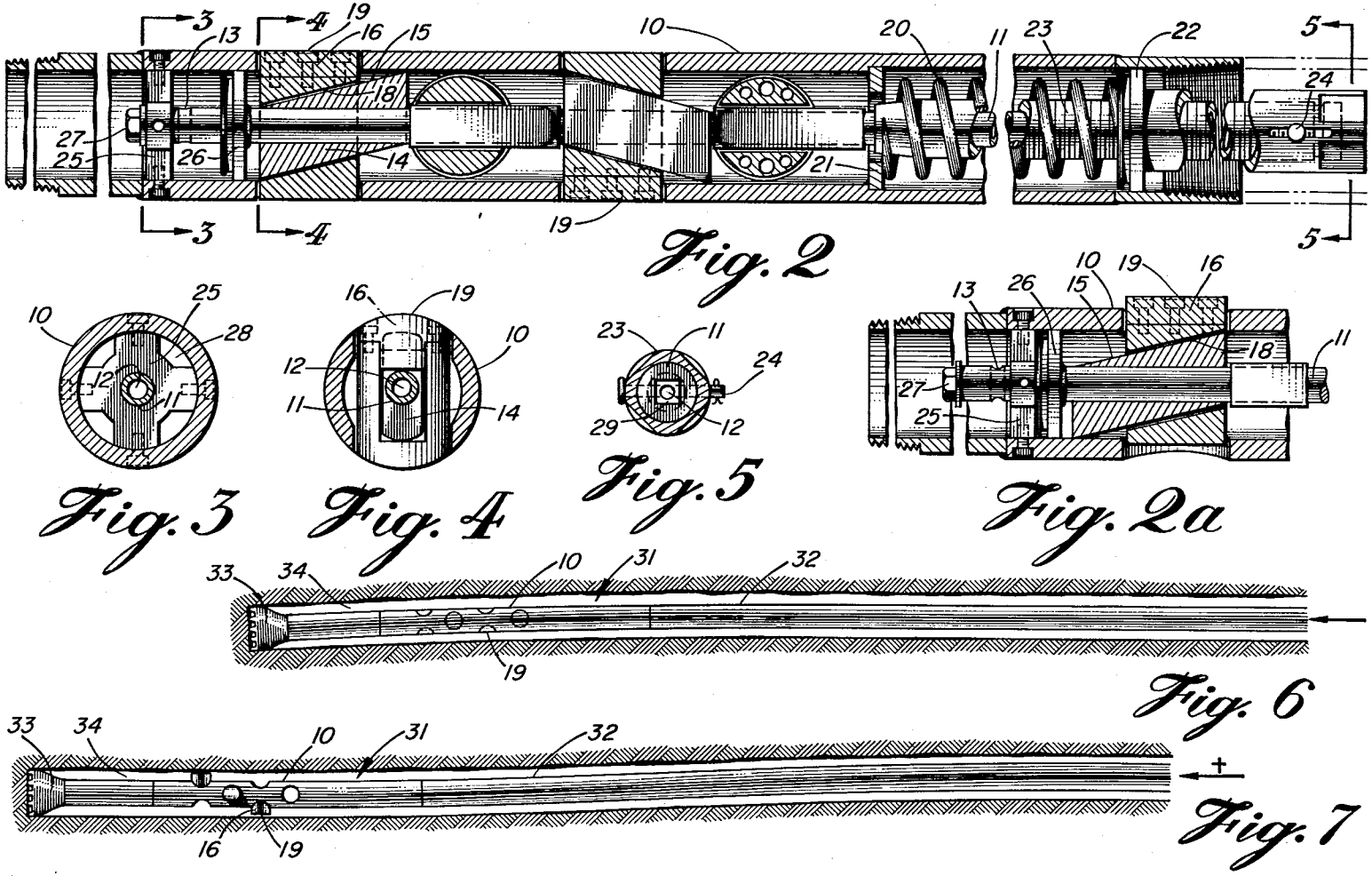
FIG. 2 is a cross section of the stabilizer shown in FIG. 1, the stabilizer being in the retracted configuration.
FIG. 2*a* is a cross section of the forward part of the stabilizer in the expanded position.
FIG. 3 is a cross section taken through the line 3—3 of FIG. 2.
FIG. 4 is a cross section taken through the line 4—4 in FIG. 2.
FIG. 5 is a cross section taken through the line 5—5 of FIG. 2.
FIG. 6 is an illustration of a stabilizer in accordance with the invention in place on a drill rod string, the stabilizer being in the retracted configuration.
FIG. 7 is a view of the stabilizer in place on a drill rod string, the stabilizer being in the expanded position.

A stabilizer in accordance with this invention preferably forms a part of a drill rod string and is positioned adjacent a drill bit as illustrated in FIGS. 6 and 7. The details of the preferred embodiment of the stabilizer itself are shown in FIGS. 1 through 5.

As best seen in FIGS. 1 and 2, stabilizer 31 comprises an outer housing 10 having an inner piston 11 mounted therein for axial sliding movement. Piston 11 includes an axial fluid flow passage through its length and terminating in outlet 13 which preferably is a hole drilled through the piston and intersecting passage 12. Piston 11 includes four enlarged shaped sections 14 including cam surfaces 15 mounted axially along piston 11. Each shaped section 14 has an associated wall engaging member 16 shown formed of two sections joined by bolts 17 and including cam follower surfaces 18. When wall engaging members 16 are assembled surrounding a shaped section 14, as best seen in FIG. 2, it will be apparent that axial movement of piston 11 from right to left in FIG. 2 will result in movement of the outer surface 19 of wall engaging member 16 from a retracted position as seen in FIG. 2 to an expanded position as seen in FIG. 2*a*. Simultaneously, each of the wall engaging members will be extended to the expanded position shown in FIG. 2*a*.

Referring again to FIGS. 1 and 2, a coil spring 20 extending from spring retainer 21 bearing against a shoulder formed in housing 10 at one end and against a rear piston surface 22 at the other end provides a bias force to piston 11 tending to maintain the stabilizer in the retracted configuration shown in FIG. 2. The extent of the bias force can be controlled by spring strength and by adjustable spring compression setting means comprising an outer sleeve 23 extending rearwardly from rear piston surface 22. Sleeve 23 is threaded onto piston 11 to a desired position and maintained in position by locking pin 24.

Forward travel of piston 11 in housing 10 is limited by front stop member 25 which is bolted to housing 10 as seen in FIG. 2. Front piston member 26 is welded or otherwise attached to piston 11, and upon contact with front stop member 25, forward movement of piston 11 is stopped. Rearward movement of piston 11 is limited by contact of stop bolt 27 against stop member 25. Stop bolt 27 is threaded into the end of piston 11 as best seen in FIG. 1.

Fluid passage 12 through piston 11 begins at the right hand end of the device as viewed in FIG. 2 and extends axially therethrough to fluid outlet 13. The forward end of passage 12 is blocked by stop bolt 27 such that all fluid flowing through passage 12 exits through outlet 13.

Front stop member 25, as best seen in FIGS. 1 and 3, includes recessed notches 28 which allow fluid flow from fluid outlet 13 through notches 28 and on through the housing 10 and the remaining drill rod string and drill bit. This flow pattern occurs when the piston is in the position shown in FIG. 2.

When it is desired to change the stabilizer to the expanded configuration, fluid pressure upstream from the stabilizer is increased, resulting in an increased pressure drop from fluid flow through passage 12 which in turn overcomes the bias effect of spring 20 enabling piston 11 to move from the position shown in FIG. 2 to the position shown in FIG. 2*a*. In order to assure a positive stroke of piston 11, it will be seen that as fluid outlet 13 initially moves, it enters front stop member 25 thereby momentarily stopping flow of fluid through passage 12 and causing a large increase in the force acting on rear piston surface 22 whereby piston 11 is swiftly and positively moved to the position shown in FIG. 2*a* with fluid outlet 13 extending beyond front stop member 25 such that fluid flow through the stabilizer is resumed.

The force needed to actuate the stabilizer from a retracted to an expanded configuration is a function of several design variables including the strength and compression on spring 20, the size of fluid passage 12 and the angle of the cam surfaces which move the wall engaging members. Additionally, as best seen in FIG. 1, a reduced diameter orifice 29 can be placed in flow passage 12 and retained therein by orifice retainer 30 threaded into piston 11.

The operation of the stabilizer in accordance with the invention will now be described with particular reference to FIGS. 6 and 7. A stabilizer 31 is attached to a drill rod string 32 having a drill bit 33 at its forward end. As drilling progresses through borehole 34, the pressure of fluid flowing through drill rod string 32 is maintained at a pressure low enough to enable stabilizer 31 to remain in the retracted configuration as shown in FIG. 6. In this configuration, the drill behaves as if there were no stabilizer, and the natural tendency of the drill under these conditions is to develop a slight downward angle in borehole trajectory. After a period of time, determined by operator experience and/or borehole position measurements obtained by known techniques and apparatus, it is desired to develop a slight upward angle in borehole trajectory. This can be accomplished utilizing the stabilizer of this invention by increasing the pressure of the fluid flowing through the drill rod string to the point where it overcomes the bias effect of spring 20 and enables the piston 11 to move forward, changing the stabilizer 31 from the retracted configuration shown in FIGS. 2 and 6 to the expanded configuration shown in FIGS. 2*a* and 7. In the expanded configuration, which is shown somewhat exaggerated in FIG. 7, the wall engaging members 16 extend to provide an effective diameter approximating that of the borehole 34. This has the same effect as having a fixed stabilizer near the drill bit. However, it avoids the necessity of removing the entire drill rod string and inserting a fixed stabilizer to provide the upward trajectory to the borehole.

Thus, utilizing the stabilizer of this invention, an operator can control the trajectory of a borehole by alternately drilling with the stabilizer in the retracted and expanded configurations.

It will be appreciated that numerous variations from and modifications to the device as illustrated and described could be made without departing from the invention. For example, the device as described includes a wall engaging member at each 90° arc about the circumference of the stabilizer. More or fewer wall engaging members appropriately distributed could be utilized.

We claim:

1. A variable diameter drill rod stabilizer for use in a drilling operation comprising:

(a) an outer housing adapted to attach to and become a part of a drill rod string;

(b) a piston within said housing, said piston having a flow passage therethrough, a flow passage outlet, and being capable of limited axial movement within said housing;

(c) a plurality of cam members including cam surface means axially positioned along said piston;

(d) a plurality of borehole wall engaging members contained in said housing and including cam follower surfaces associated with said cam surface means whereby said wall engaging members move from a contracted position to an expanded position beyond the outer surface of said housing in response to axial movement of said piston;

(e) bias means adapted to prevent forward movement of said piston within said housing in response to a first lower pressure drop of fluid flowing through said flow passage and to allow forward movement of said piston within said housing in response to a second higher pressure drop of fluid flowing through said flow passage; and (f) a piston stop member including longitudinal flow passage means therethrough, said stop member being downstream from the outlet of the flow passage through said piston when said stabilizer is in the contracted position and upstream from said stop member when said stabilizer is in the expanded position.

2. A drill rod stabilizer in accordance with claim 1 wherein four cam members and four associated wall engaging members are provided, said cam members and wall engaging members being arranged whereby when the stabilizer is in the expanded position one wall engaging member extends beyond said housing at each 90° interval about said housing.

3. A drill rod stabilizer in accordance with claim 2 whereby said outlet of said flow passage through said piston enters said front stop member when said stabilizer is moving from the contracted position to the expanded position, said front stop member being adapted to momentarily stop flow of fluid through said piston as said outlet passes through said front stop member.

* * * * *